US011466651B2

(12) United States Patent
Kurtz et al.

(10) Patent No.: US 11,466,651 B2
(45) Date of Patent: Oct. 11, 2022

(54) FUEL INJECTOR WITH DUCT ASSEMBLY

(71) Applicant: Ford Global Technologies, LLC, Dearborn, MI (US)

(72) Inventors: Eric Kurtz, Dearborn, MI (US); Daniel Kantrow, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 103 days.

(21) Appl. No.: 16/052,532

(22) Filed: Aug. 1, 2018

(65) Prior Publication Data

US 2020/0040857 A1 Feb. 6, 2020

(51) Int. Cl.

| | |
|---|---|
| ***F02M 61/18*** | (2006.01) |
| ***F02M 61/14*** | (2006.01) |
| ***F02F 1/24*** | (2006.01) |
| ***F02M 61/16*** | (2006.01) |

(52) U.S. Cl.

CPC ..... *F02M 61/182* (2013.01); *F02F 1/242* (2013.01); *F02M 61/145* (2013.01); *F02M 61/168* (2013.01); *F02M 2200/85* (2013.01)

(58) Field of Classification Search

CPC .. F02M 61/182; F02M 61/145; F02M 61/168; F02M 2200/85; F02F 1/242

USPC ..... 123/470

See application file for complete search history.

(56) References Cited

U.S. PATENT DOCUMENTS 2,553,222 A * 5/1951 Wallgren ..... F16J 15/0881 285/918
3,410,256 A * 11/1968 Herschmann ..... F02F 1/166 123/193.3
4,177,948 A * 12/1979 Schaffitz ..... F02M 61/1806 239/533.3
4,474,147 A * 10/1984 Hoopes ..... F16J 15/0881 277/601
4,513,703 A * 4/1985 Eckert ..... F02F 11/002 123/669
4,595,144 A * 6/1986 Wiegand ..... F02M 61/182 239/408
4,791,891 A * 12/1988 Kubis ..... F02F 11/002 123/193.2
5,664,789 A * 9/1997 Hayashi ..... F15B 13/0839 277/345
9,382,889 B2 * 7/2016 Beltran Corona ... F02M 69/047
9,506,439 B2 * 11/2016 Anders ..... F02D 41/38
9,587,606 B2 * 3/2017 Anders ..... F02M 61/1833
9,803,538 B2 * 10/2017 Anders ..... F02B 23/02
10,012,196 B1 * 7/2018 Qi ..... F02M 61/14
10,060,334 B2 * 8/2018 Polonowski ..... F02B 19/18
10,077,724 B1 * 9/2018 Kurtz ..... F02D 41/0025
10,151,235 B2 * 12/2018 Anders ..... F02M 61/166

(Continued)

FOREIGN PATENT DOCUMENTS

GB 2031995 A * 4/1980 ..... F02M 69/047

*Primary Examiner* — Logan M Kraft

*Assistant Examiner* — John D Bailey

(74) *Attorney, Agent, or Firm* — Vincent Mastrogiacomo; McCoy Russell LLP

(57) ABSTRACT

Methods and systems are provided for a fuel injector of an internal combustion engine. In one example, a fuel injector includes a body having a flange shaped to seat within a shoulder of a passage of a cylinder head. The shoulder is positioned at an inner side of the cylinder head such that the fuel injector is coupled to the cylinder head at the inner side by the flange.

14 Claims, 11 Drawing Sheets

(56) References Cited

U.S. PATENT DOCUMENTS 10,544,726 B2 * 1/2020 Kurtz ..... F02M 25/03
10,711,752 B2 * 7/2020 Martin ..... F02M 61/168
2004/0045533 A1 * 3/2004 Sukegawa ..... F02D 13/0226 123/549
2007/0170661 A1 * 7/2007 Mancenido ..... F16J 15/08 277/600
2012/0186555 A1 * 7/2012 Mueller ..... F02F 3/24 123/294
2013/0081598 A1 * 4/2013 Beltran Corona ..... F02M 35/10072 239/584
2013/0306008 A1 * 11/2013 Bossner ..... F02F 11/00 29/458
2016/0097360 A1 * 4/2016 Mueller ..... F02M 61/1813 123/294
2016/0169086 A1 * 6/2016 Svensson ..... F02B 23/02 123/294
2016/0298528 A1 * 10/2016 Svensson ..... F02F 3/28
2016/0298529 A1 * 10/2016 Anders ..... F02B 23/02
2016/0298531 A1 * 10/2016 Anders ..... F02M 61/1806
2016/0298583 A1 * 10/2016 Anders ..... F02M 61/1833
2016/0298584 A1 * 10/2016 Svensson ..... F02B 23/0627
2016/0327000 A1 * 11/2016 John ..... F02M 61/1813
2017/0009712 A1 * 1/2017 Svensson ..... F01P 3/02
2017/0016384 A1 * 1/2017 Koci ..... F02B 23/10
2017/0089310 A1 * 3/2017 Svensson ..... F02B 23/0651
2018/0030920 A1 * 2/2018 Wicks ..... F01L 3/04
2018/0195430 A1 * 7/2018 Fitzgerald ..... F02D 41/3005
2018/0258836 A1 * 9/2018 Anders ..... F02B 23/00
2018/0266339 A1 * 9/2018 Kurtz ..... F02M 25/03
2019/0063391 A1 * 2/2019 Martin ..... F02M 61/1806

* cited by examiner

FUEL INJECTOR WITH DUCT ASSEMBLY

GOVERNMENT RIGHTS

This invention was made with government support under CRADA No. SC16/01875.00.00 awarded by the Department of Energy. The government has certain rights in the invention.

FIELD

The present description relates generally to methods and systems for a fuel injector of a motorized vehicle.

BACKGROUND/SUMMARY

Combustion chambers of internal combustion engines are often configured to receive fuel via direct fuel injection from nozzles of one or more fuel injectors. Ducts may be positioned within the combustion chambers proximate to the nozzles of the fuel injectors, and fuel may be injected into the combustion chambers from the nozzles and through the ducts. Injecting the fuel through the ducts may increase an amount of mixing of the fuel and air within the combustion chambers.

Some ducts include a threaded body adapted to mate with one or more counterpart features of the fuel injectors. Each threaded body may couple to a corresponding fuel injector in order to secure the ducts in the position proximate to the nozzle of the fuel injector. One example approach is shown by Mueller in US 2016/0097360. Therein, a duct is disclosed, with the duct located proximate to an opening in a fuel injector tip. The duct may be coupled to a locator ring, with the locator ring coupled to the fuel injector.

However, the inventors herein have recognized potential issues with such systems. As one example, it may be difficult to align each hole of the nozzle of the fuel injector with a corresponding duct while the ducts are coupled to the fuel injector. Misalignment of the holes with the ducts may decrease the mixing of fuel and air within the combustion chamber and/or may reduce combustion stability.

In one example, the issues described above may be addressed by a system, comprising: a cylinder head including a passage extending from an outer surface to an inner surface of the cylinder head, a shoulder formed within the passage proximate to the inner surface, the shoulder forming a larger passage opening at the inner surface than the outer surface, the inner surface forming a top of a combustion chamber; and a fuel injector including a nozzle and a plurality of ducts arranged at a distal end of the fuel injector, where the distal end includes a flange that is wider than a body of the fuel injector extending toward a proximal end of the fuel injector, the flange adapted to seat within the shoulder. In this way, an alignment of the nozzle with the plurality of ducts may be increased as the fuel injector is coupled with the shoulder.

As one example, a diameter of the passage may be smaller than a diameter of the passage opening at the inner surface formed by the shoulder. By coupling the fuel injector with the shoulder at the inner surface, a length of the ducts may be increased relative to the diameter of the passage, and mixing of fuel and air within the combustion chamber may be increased. Further, increasing the alignment of the nozzle with the plurality of ducts may increase the mixing of fuel and air, and engine performance may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-10 are shown to scale, although other relative dimensions may be used, if desired.

DETAILED DESCRIPTION

Figure 2:
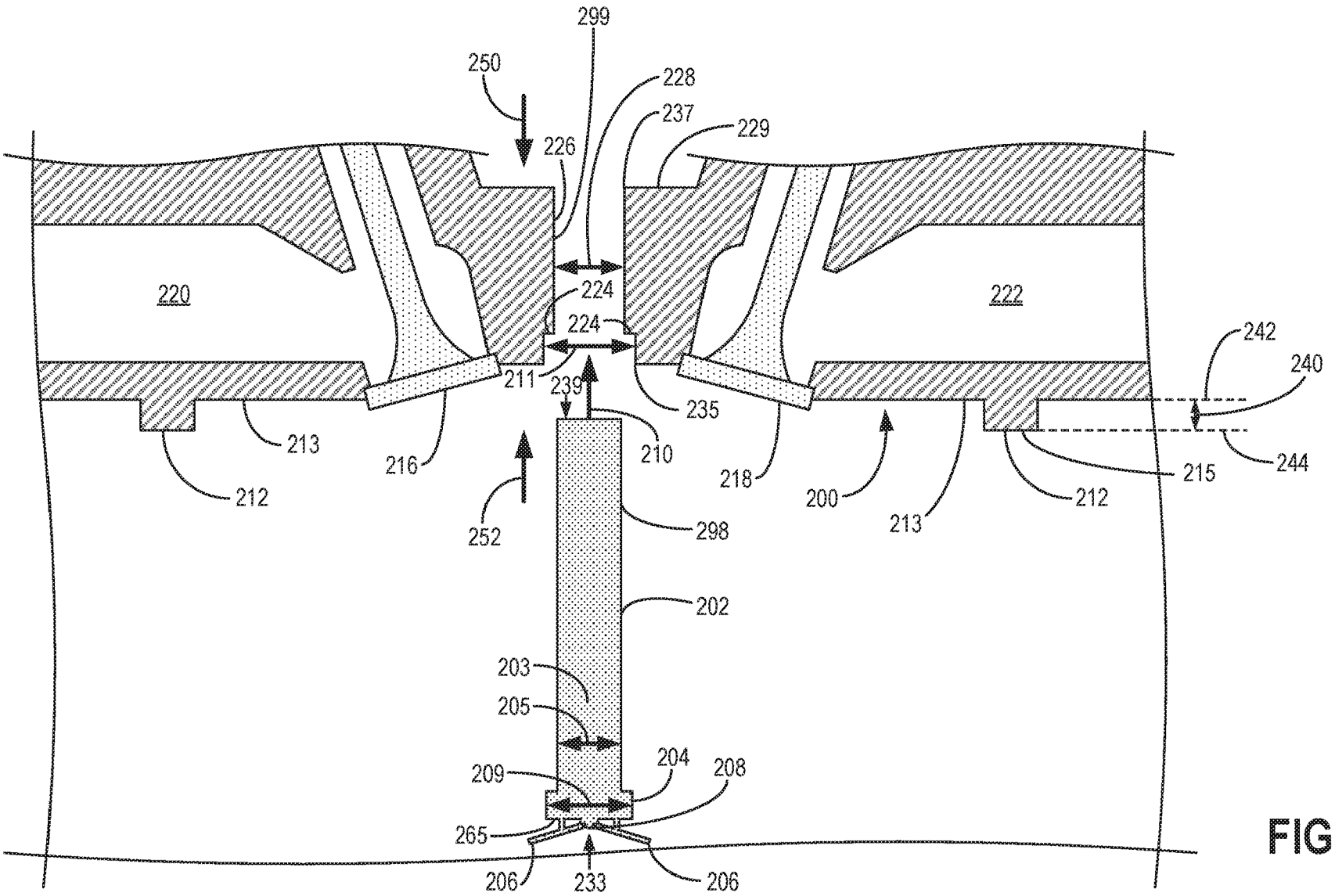
FIG. 2 shows a first partial cross-sectional view of a cylinder head including a shoulder, with a fuel injector decoupled from the shoulder.
Figure 3:
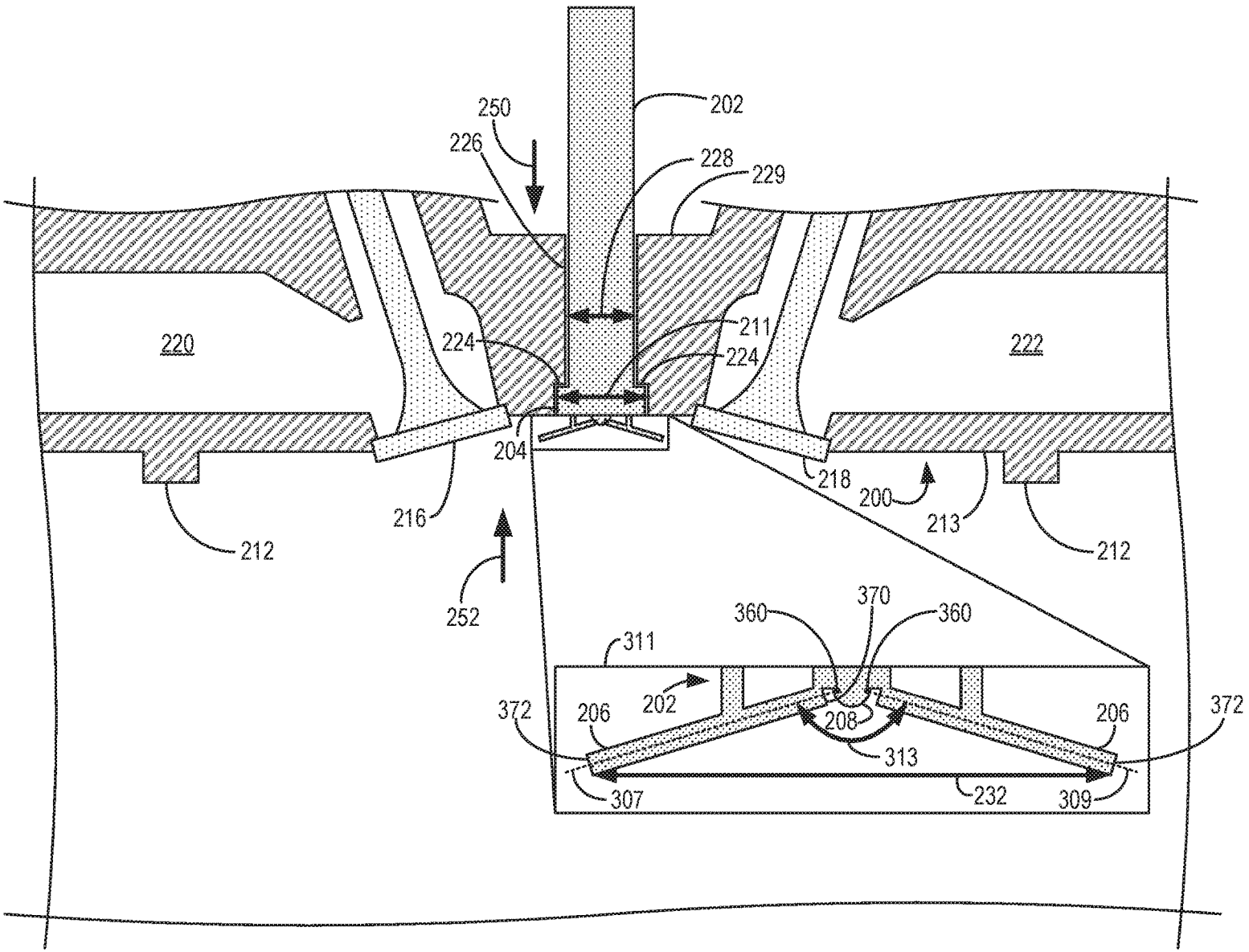
FIG. 3 shows the fuel injector of FIG. 2 coupled to the shoulder of the cylinder head.
Figure 4:
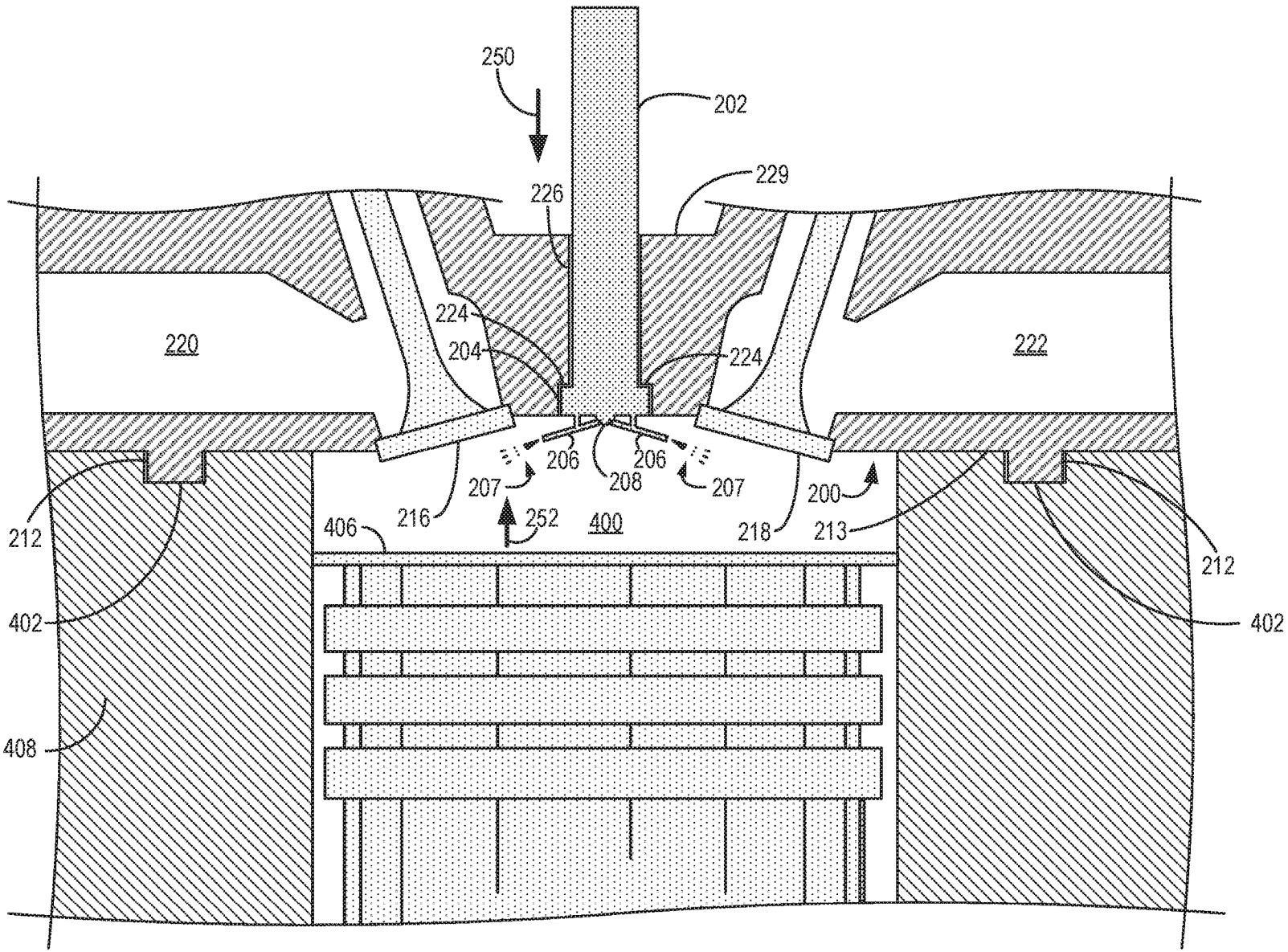
FIG. 4 shows the cylinder head of FIGS. 2-3 coupled to an engine block.
Figure 5:
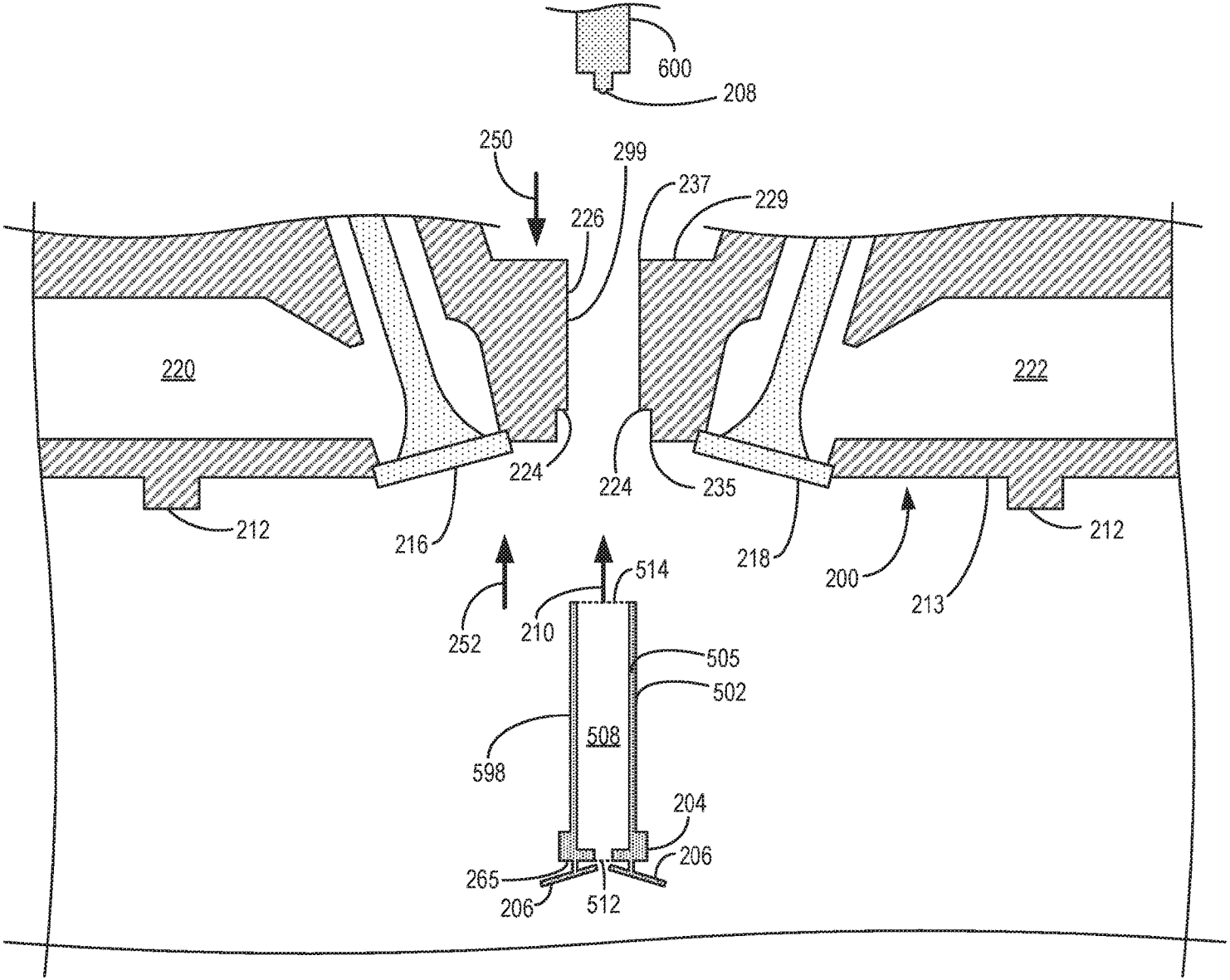
FIG. 5 shows a second partial cross-sectional view of a cylinder head including a shoulder, with a duct section of a fuel injector decoupled from the shoulder.
Figure 6:
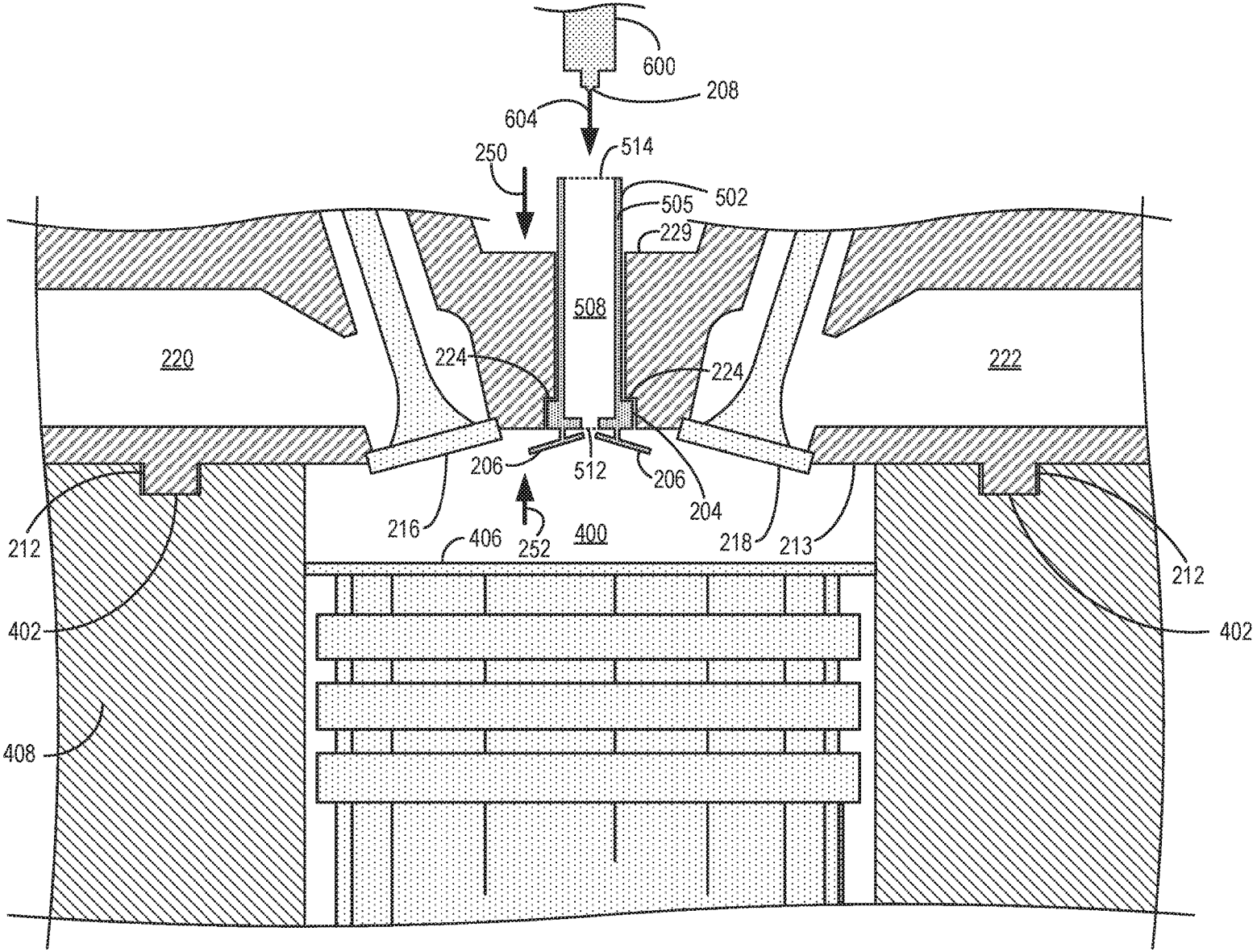
FIG. 6 shows the duct section of FIG. 5 coupled to the shoulder of the cylinder head, with the cylinder head coupled to an engine block.
Figure 7:
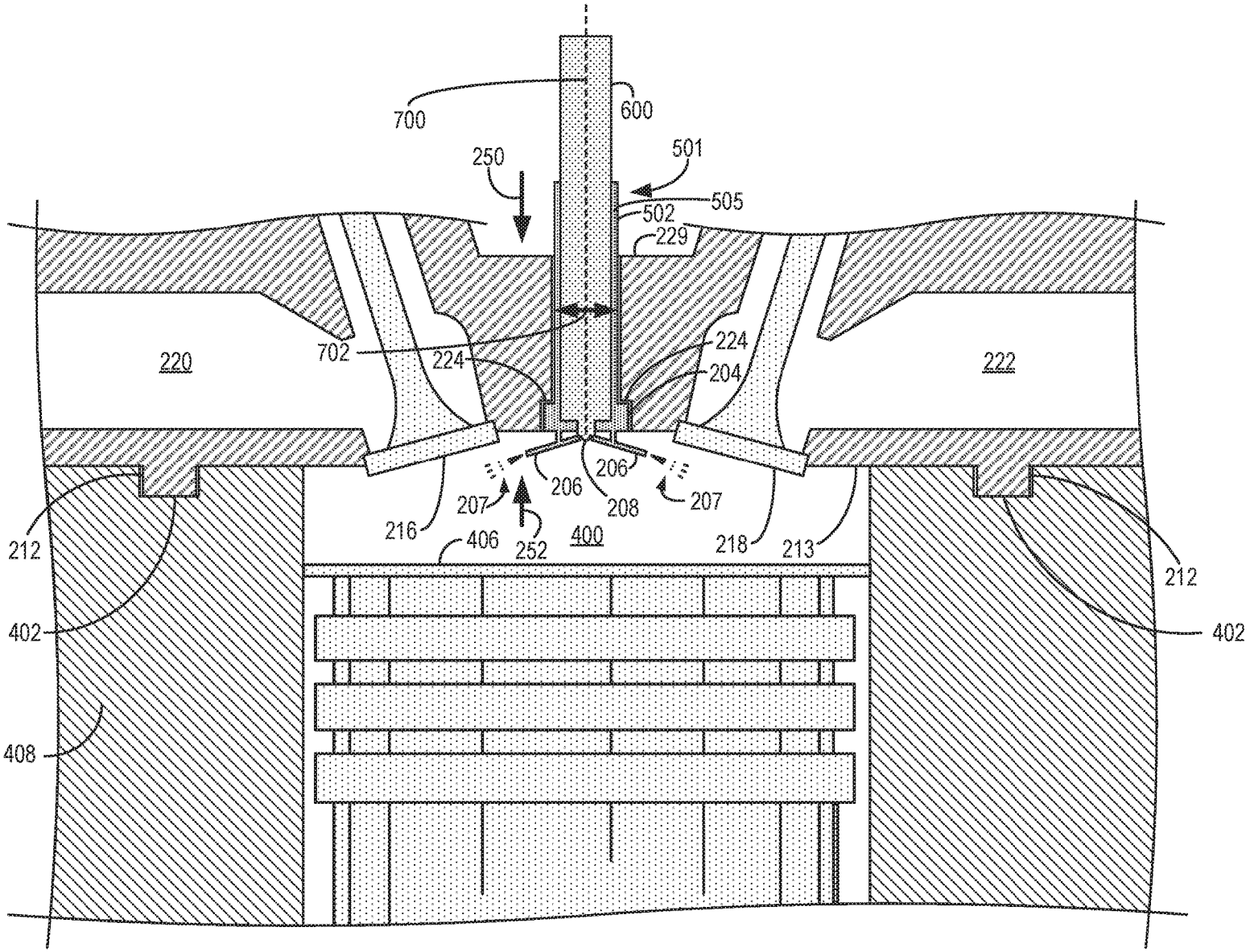
FIG. 7 shows a nozzle section of the fuel injector coupled to the duct section of FIGS. 5-6.
Figure 8:
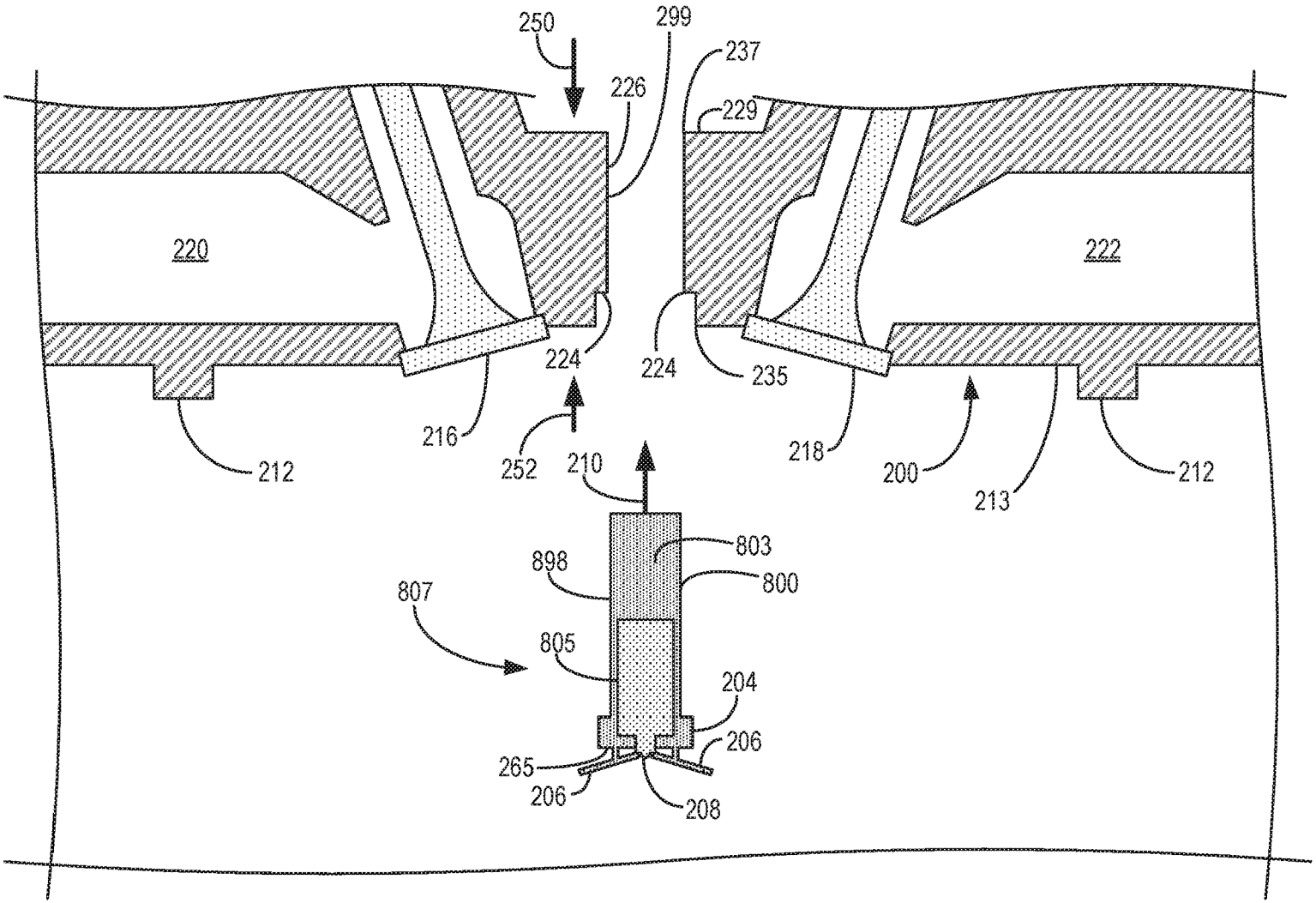
FIG. 8 shows a third partial cross-sectional view of a cylinder head including a shoulder, with a nozzle/duct section of a fuel injector decoupled from the shoulder.
Figure 9:
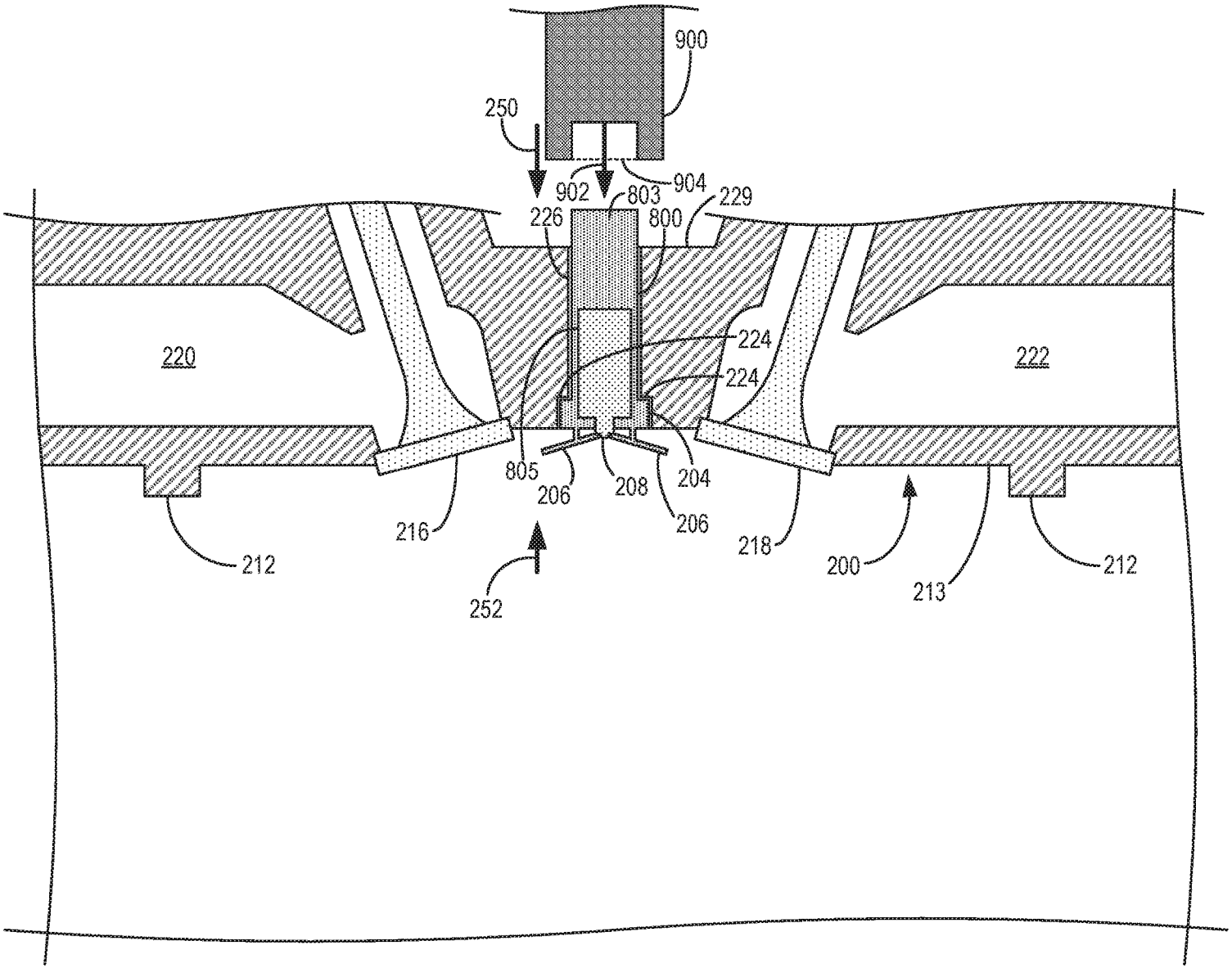
FIG. 9 shows the nozzle/duct section of FIG. 8 coupled to the shoulder of the cylinder head.
Figure 10:
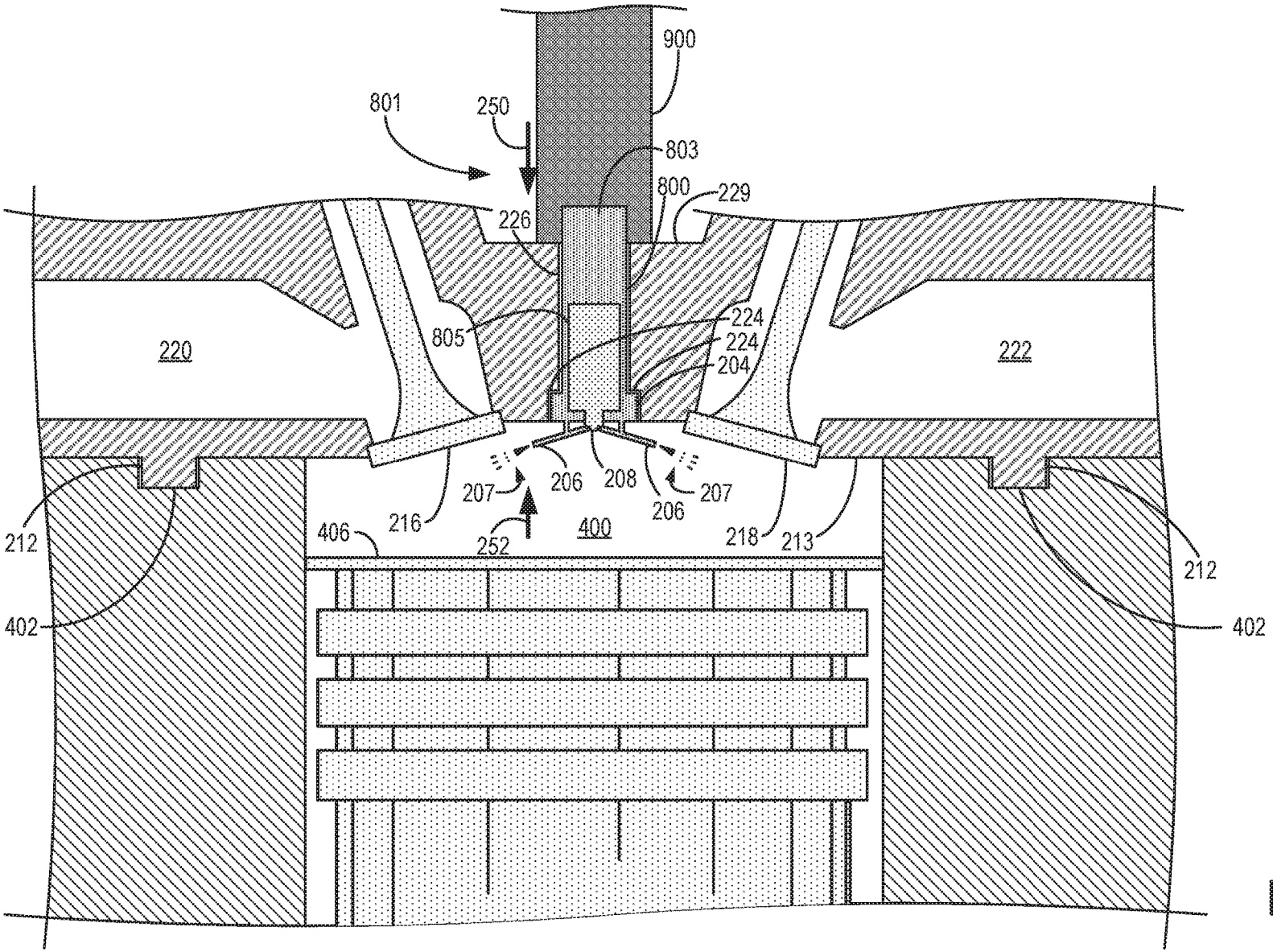
FIG. 10 shows a fuel injector body coupled to the nozzle/duct section of FIGS. 8-9, with the cylinder head coupled to an engine block.
Figure 11:
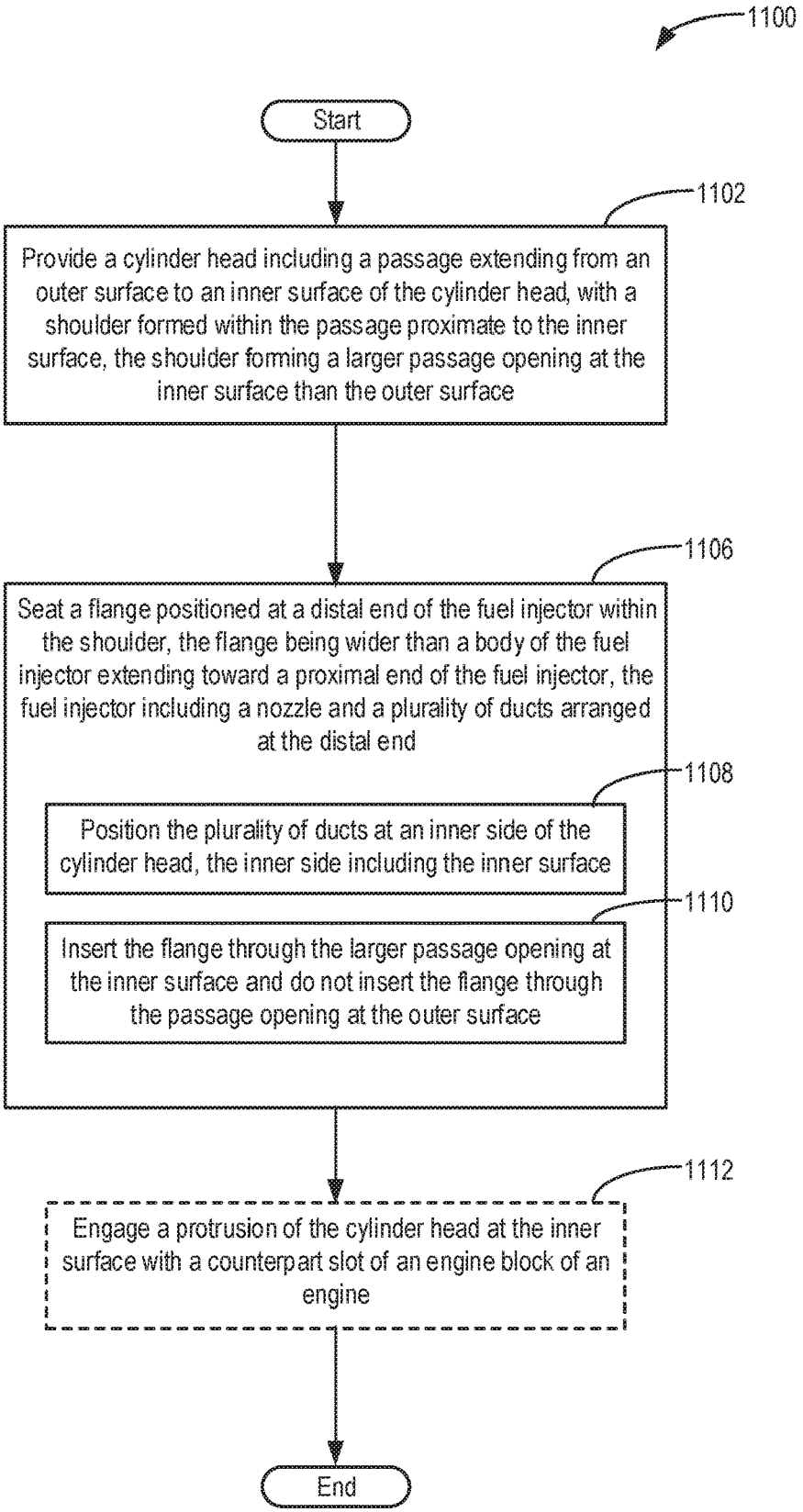
FIG. 11 shows a method for coupling a fuel injector to a cylinder head via engagement of a flange of the fuel injector with a shoulder of the cylinder head.

The following description relates to systems and methods for a fuel injector of a motorized vehicle. A vehicle including an engine, such as the engine shown schematically by FIG. 1, includes a cylinder head and a fuel injector. The cylinder head includes a shoulder positioned at an inner surface of the cylinder head, such as the shoulder shown by FIG. 2. The fuel injector is shaped to couple with the shoulder at an inner side of the cylinder head, as shown by FIG. 3, and the inner side of the cylinder head may be coupled to an engine block to form one or more combustion chambers of the engine, as shown by FIG. 4. In some examples, as shown by FIGS. 2-4, a nozzle, body, and ducts of the fuel injector may be integrated together as a single unit. In another example, as shown by FIGS. 5-7, the fuel injector includes a duct section coupleable with the shoulder at the inner side of the cylinder head and a nozzle section coupleable with the duct section at an outer side of the cylinder head. In yet another example, as shown by FIGS. 8-10, the fuel injector includes a nozzle/duct section coupleable with the shoulder of the cylinder head at the inner side of the cylinder head and a body coupleable with the nozzle/duct section at the outer side of the cylinder head. By coupling the fuel injector with the shoulder of the cylinder head at the inner side of the cylinder head (as illustrated by the flowchart of FIG. 11), a retention force applied to the fuel injector may be increased by combustion of fuel/air within the combustion chamber. Further, by coupling the fuel injector with the shoulder at the inner side of the cylinder head, a length of the ducts may be increased relative to a diameter of a passage opening formed by the shoulder, and mixing of fuel and air within the combustion chambers via the ducts may be increased. Additionally, the ducts and nozzle may be formed together to enable holes of the nozzle to align with the ducts as the fuel injector is coupled with the shoulder.

Figure 1:
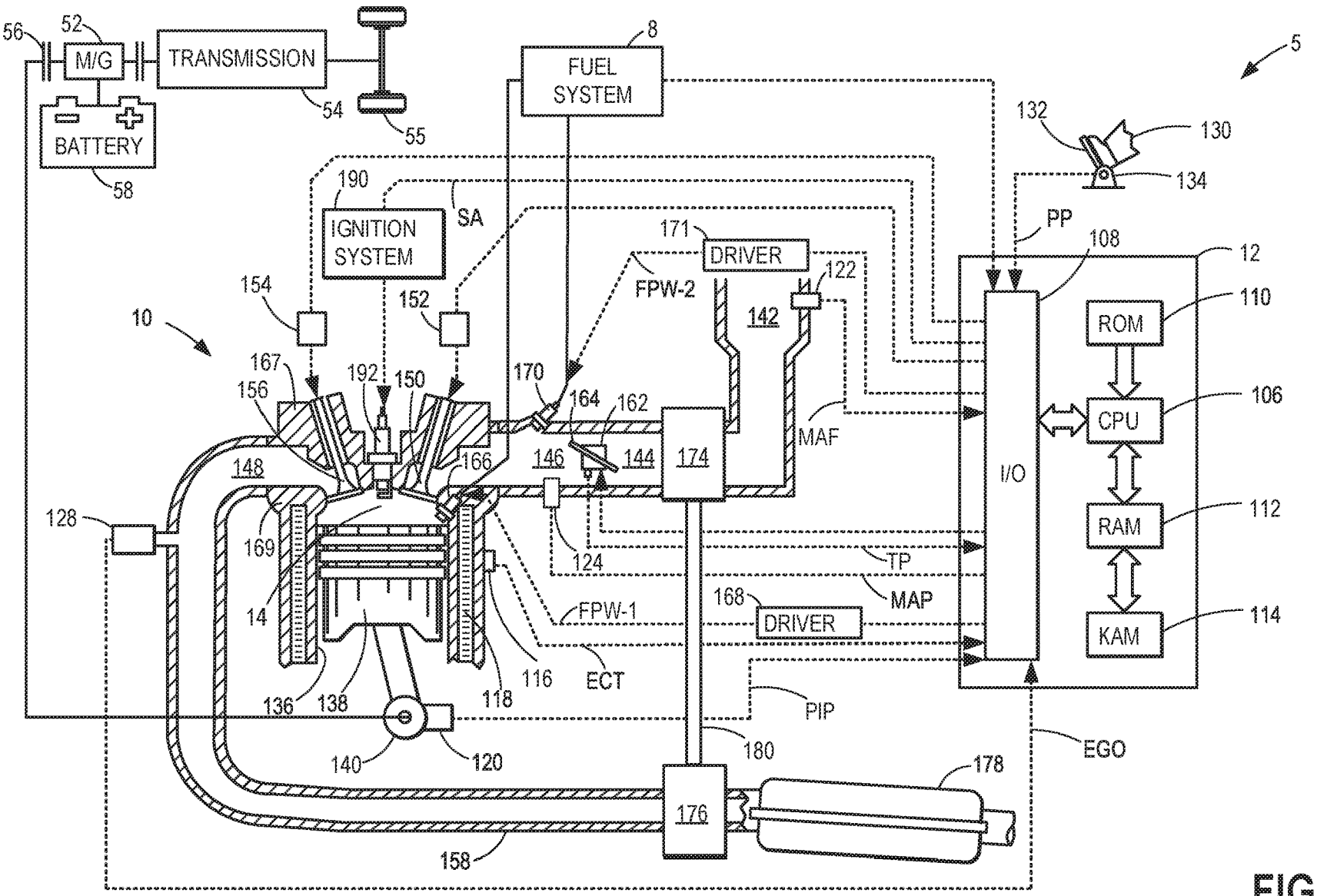
FIG. 1 schematically shows an engine system including a cylinder head and a fuel injector.

FIG. 1 depicts an example of a combustion chamber or cylinder of internal combustion engine 10. In some examples, as described below, engine 10 may be a diesel engine driven by combustion of diesel fuel. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 formed by an engine block 169 of the engine 10 and capped by cylinder head 167. Cylinder 14 includes piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, urea-SCR catalyst, diesel oxidation catalyst, DPF, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock. Further, in some examples in which engine 10 is a diesel engine, the compression ratio may be in a range of 15:1 to 17:1. Combustion of diesel fuel within cylinder 14 may occur via compression ignition.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines. For example, in embodiments in which engine 10 is a diesel engine, spark plug 192 may be replaced by a glow plug.

Each cylinder of engine 10 is configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. Fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14.

While FIG. 1 shows injector 166 positioned to one side of cylinder 14, it may alternatively be located overhead of the piston, such as near the position of spark plug 192 (e.g., similar to the examples shown by FIGS. 2-10 and described below). Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternative example, each of fuel injectors 166 and 170 may be configured as direct fuel injectors for injecting fuel directly into cylinder 14. Although fuel injector 166 is shown positioned at a sidewall of cylinder 14 in FIG. 1, in some examples the fuel injector 166 may be positioned at a center of the cylinder 14. For example, fuel injector 166 may be positioned at the location of spark plug 192 shown in FIG. 1. In yet another example in which engine 10 is a diesel engine including a glow plug, the fuel injector 166 may be positioned adjacent to the glow plug at the center of cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as Eli) (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. Controller 12 may infer an engine temperature based on an engine coolant temperature. The controller 12 receives signals from the various sensors of FIG. 1 and employs the various actuators of FIG. 1 to adjust engine operation based on the received signals and instructions stored on a memory of the controller.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

Turning now to FIGS. 2-4, different stages of coupling of a cylinder head 200 and fuel injector 202 are shown. Specifically, FIG. 2 shows the fuel injector 202 decoupled from the cylinder head 200, FIG. 3 shows the fuel injector 202 coupled (e.g., seated) within a shoulder 224 of the cylinder head 200, and FIG. 4 shows the cylinder head 200 coupled to an engine block 408 of an engine (e.g., engine 10 shown by FIG. 1 and described above). Cylinder head 200 may be similar to the cylinder head 167 shown by FIG. 1 and described above, and fuel injector 202 may be similar to fuel injector 166 shown by FIG. 1 and described above. In one example, assembly of the cylinder head 200 with the fuel injector 202 and engine block 408 may occur sequentially from the configuration shown by FIG. 2 to the configuration shown by FIG. 3, and from the configuration shown by FIG. 3 to the configuration shown by FIG. 4.

As shown by FIG. 2, the cylinder head 200 includes an intake passage 222 sealed by an intake valve 218, an exhaust passage 220 sealed by an exhaust valve 216, and a fuel injector passage 226 adapted to receive the fuel injector 202. The intake passage 222, intake valve 218, exhaust passage 220, and exhaust valve 216 may be similar to the intake passage 146, intake valve 150, exhaust passage 148, and exhaust valve 156, respectively, shown by FIG. 1 and described above.

In the view shown by FIG. 2, cylinder head 200 is separated from the engine block 408 shown by FIG. 4 (e.g., not coupled to the engine block 408). In one example, the cylinder head 200 may be in the configuration shown by FIG. 2 during assembly of the engine. In some examples, cylinder head 200 may include one or more protrusions 212 extending in an outward direction from an inner surface 213 of the cylinder head 200. The protrusions 212 may be shaped to engage with counterpart slots of the engine block 408 (e.g., slots 402 shown by FIG. 4). In one example, protrusions 212 may be formed together with the cylinder head 200 a single piece (e.g., molded together with the cylinder head 200 such that the protrusions 212 are not separable from the cylinder head 200). In other examples, the protrusions 212 may be removably coupled to the cylinder head 200 (e.g., temporarily fastened to the cylinder head 200 via adhesive, one or more fasteners, etc.).

The protrusions 212 may be further utilized during assembly of the engine in order to provide a clearance formed between the inner surface 213 and each end surface 215. Further, the clearance may be formed between the inner surface 213 of the cylinder head 200 and a surface on which the cylinder head 200 sits during conditions in which the end surfaces 215 are in direct contact (e.g., face-sharing contact) with the surface on which the cylinder head 200 sits. For example, during assembly of the engine and prior to coupling the cylinder head 200 to the engine block 408, an end surface 215 (which may be referred to herein as a terminal end) of each protrusion 212 may be positioned in face-sharing contact with a work surface, such as a table (e.g., positioned in direct contact with the work surface with no other components positioned between the end surface 215 and the work surface). Because the inner surface 213 of the cylinder head 200 is offset from the end surface 215 of the protrusions 212 (e.g., as indicated by length 240 between axis 242 positioned parallel with the inner surface 213 and axis 244 positioned parallel with the end surface 215), the protrusions 212 provide the clearance between the work surface and the inner surface 213. The clearance may reduce a likelihood of degradation of components of the engine coupled to the cylinder head 200 during assembly of the engine, such as the intake valve 218, exhaust valve 216, and/or ducts 206 of the fuel injector 202. Specifically, the clearance may reduce a likelihood of the ducts 206 coming into contact with the work surface by ensuring that the ducts do not extend beyond the clearance in the direction of inner side 252 during conditions in which flange 204 is seated within shoulder 224, and may thereby reduce a likelihood of degradation of the ducts 206.

Although the cylinder heads described herein (e.g., cylinder head 200) may include the protrusions 212, in some examples, the protrusions 212 may not be included. Similarly, although the engine blocks described herein (e.g., engine block 408 shown by FIG. 4) may include the slots 402, in some examples, slots 402 may not be included.

FIG. 2 shows an insertion direction 210 of the fuel injector 202 into the passage 226 of the cylinder head 200. Specifically, fuel injector 202 is coupled with the cylinder head 200 by inserting the fuel injector 202 into the passage 226 in the insertion direction 210 from inner side 252 of the cylinder head 200 toward outer side 250 of the cylinder head 200 (e.g., in the direction from inner surface 213 toward outer surface 229). Inner surface 213 is disposed at the inner side 252, and inner surface 213 may partially form at least one combustion chamber of the engine (e.g., cap at least one combustion chamber) during conditions in which the cylinder head 200 is coupled to the engine block 408 (as shown by FIG. 4).

As the fuel injector 202 is inserted into the passage 226, one or more portions of the fuel injector 202 couple with the shoulder 224 of the cylinder head 200 in order to maintain the position of the fuel injector 202 relative to the cylinder head 200 and to provide sealing between the head and the combustion chamber. For example, fuel injector 202 includes flange 204 positioned at distal end 233 of the fuel injector 202 (e.g., the end of the fuel injector 202 including nozzle 208 and ducts 206, with distal end 233 being opposite to proximal end 239), with flange 204 shaped to couple to the shoulder 224 (e.g., seat within the shoulder 224). Shoulder 224 is formed within passage 226 and is proximate to inner surface 213. A diameter 209 of the flange 204 may be approximately a same diameter as a diameter 211 of an opening 235 of passage 226 formed by the shoulder 224, with the diameter 211 of the opening 235 (e.g., diameter of the shoulder 224) being larger than diameter 228 of opening 237 positioned at outer side 250 (e.g., at outer surface 229). For example, diameter 209 may be slightly smaller than diameter 211 to enable the flange 204 to seat within the shoulder 224 (e.g., abut against the surfaces of the shoulder 224), but diameter 209 may not be smaller than diameter 211 to an extent that the flange 204 may tilt, pivot, and/or move in directions other than insertion direction 210 within the shoulder 224. Further, diameter 209 is larger than diameter 205 of body 205 of the fuel injector 202. As the fuel injector 202 is inserted into the opening and through the passage 226 in the insertion direction 210, the flange 204 may mate with surfaces of the shoulder 224 in order to maintain the fuel injector 202 in engagement with the cylinder head 200. Further, as the fuel injector is inserted into the opening and through the passage 226, outer surfaces 298 of body 203 may engage with (e.g., be positioned in face-sharing contact with) inner surfaces 299 of the passage 226.

During conditions in which the flange 204 is mated with the shoulder 224 (e.g., positioned in face-sharing contact with surfaces of the shoulder 224), the shoulder 224 may reduce a likelihood of the fuel injector 202 being inserted further into the passage 226. For example, the flange 204 may press against the surfaces of the shoulder 224 such that during conditions in which the flange 204 is fully seated within the shoulder 224, the nozzle 208 and ducts 206 protrude (e.g., extend) outward (e.g., toward the inner side 252) from the inner surface 213 at shoulder 224 such that the ducts are positioned at the inner side 252. The ducts 206 are coupled to bottom 265 of the flange 204, with the bottom 265 being positioned at the inner side 252 while the flange 204 is seated within the shoulder 224. The ducts 206 extend outward from the bottom 265, and the nozzle 208 extends outward from the bottom 265 between the ducts 206 (e.g., the ducts 206 are positioned around the nozzle 208 and encircle the nozzle 208 at the bottom 265). Seating the flange 204 within the shoulder 224 includes inserting the flange 204 through the larger passage opening 235 at the inner surface 213 and not inserting the flange 204 through the passage opening 237 at the outer surface 229.

Further, diameter 228 of the passage 226 is smaller than each of the diameter 209 of the flange 204 and the diameter 211 of the shoulder 224 such that the flange 204 may abut surfaces of the shoulder 224 but does not extend beyond the shoulder 224 and further into the passage 226, as shown by FIGS. 3-4. Body 203 of the fuel injector 202 has a diameter 205 that may be approximately the same diameter as the diameter 228 of the passage 226, and the body 203 extends between distal end 233 and proximal end 239. For example, diameter 205 may be slightly smaller than diameter 228 to enable the body 203 to slide into the passage 226, but diameter 205 may not be smaller than diameter 228 to an extent that the body 203 may tilt, pivot, and/or move in directions other than insertion direction 210 within the passage 226.

FIG. 3 shows the fuel injector 202 coupled to the cylinder head 200, with the flange 204 of the fuel injector 202 mated with the shoulder 224. In this configuration, the nozzle 208 and ducts 206 extend outward at the inner side 252 of the cylinder head 200 away from the inner surface 213, as described above. A length 232 between the ducts 206 may be greater than the diameter 211 of the flange 204 and/or the diameter 228 of the passage 226. Each duct 206 includes a first end 370 and a second end 372, with the first end 370 positioned closer to the flange 204 than the second end 372. The length 232 extends between each second end 372 of opposing ducts 206 (e.g., ducts positioned apart from each other at opposing sides of nozzle 208). Each of the ducts 206 is arranged concentrically with a corresponding spray hole of the nozzle 208. In examples in which the number of spray holes of nozzle 208 is even (e.g., 2, 4, etc.), opposing ducts 206 may be positioned 180 degrees apart from each other across nozzle 208 (e.g., at opposing sides of the nozzle 208). In other examples, the number of spray holes of the nozzle 208 may be odd (e.g., 3, 5, etc.) and/or positioned asymmetrically around the nozzle 208. However, in each example, a length from a center of the nozzle 208 to the second end 372 of at least one of the ducts 206 may be greater than a radius of the flange 204 and/or radius of the passage 226.

In some examples, the length 232 may be greater than half the diameter 228 of passage 226 (e.g., greater than a radius of passage 226). By coupling the fuel injector 202 with the cylinder head 200 at the inner side 252 of the cylinder head 200 via the flange 204 and shoulder 224 (e.g., during assembly of the engine), the length 232 between the ducts 206 may be increased relative to fuel injectors that are not coupled to the cylinder head at the inner side. For example, fuel injectors that are coupled to the cylinder head at the outer side 250 (e.g., proximate to outer surface 229) and are not coupled to the cylinder head at the inner side 252 via the shoulder 224 and flange 204 may be difficult to insert into the passage 226 if the length between the ducts 206 exceeds the diameter 228 of the passage 226. Specifically, the ducts 206 may not fit within the passage 226 in examples in which the length between the ducts is greater than the diameter 228 of the passage 226.

By enabling the length between the ducts 206 to be greater than the diameter 228 of the passage 226 via coupling of the fuel injector 202 with the cylinder head 200 at the inner side 252 (e.g., via flange 204 and shoulder 224), a length of the ducts 206 may be increased. For example, the length of one or more of the individual ducts may be increased relative to ducts of fuel injectors that are coupled to the cylinder head at the outer side 250 and not the inner side 252. The increased duct length may increase a mixing of fuel from holes of the nozzle of the fuel injector 202 with air within the combustion chamber during conditions in which the cylinder head 200 is coupled to the engine block 408 (e.g., as shown by FIG. 4), and the increased mixing may result in increased engine performance (e.g., increased combustion stability). The holes of the nozzle are adapted to align with the ducts 206 (e.g., each hole of the nozzle may align with a corresponding duct 206, such as holes 360 shown by inset 311 of FIG. 3). For example, each hole of the nozzle may be positioned concentrically with a corresponding duct 206 (e.g., each hole and corresponding duct may be machined with a same tool and/or formed in a same operation). In one example, the increased length of the ducts may enable fuel to be more evenly distributed throughout the combustion chamber. For example, fuel may be injected from the fuel injector 202 and into the combustion chamber through the ducts 206, with fuel sprays 207 (shown by FIG. 4) being positioned further from the nozzle of the fuel injector relative to fuel sprays from fuel injectors that are coupled to the cylinder head only at the outer side of the cylinder head and have the reduced duct size relative to the diameter 228 of the passage 226.

Additionally and/or alternatively, by coupling the fuel injector 202 with the cylinder head 200 at the inner side 252 as described above, an angle between opposing ducts of the fuel injector 202 may be increased. As shown by inset 311 of FIG. 3, axis 307 and axis 309 are angled relative to each other by angle 313, with each of axis 307 and axis 309 positioned along opposing ducts of the fuel injector 202 and intersecting corresponding holes aligned with the ducts of the fuel injector 202. Specifically, axis 307 extends in a direction of fuel flow from nozzle 208 through a first duct and intersects one of the holes 360, and axis 309 extends in a direction of fuel flow from nozzle 208 through an opposing, second duct and intersects one of the holes 360. Because the fuel injector 202 is coupled with the cylinder head 200 at the inner side 252 via the flange 204 and shoulder 224 as described above, the angle 313 between the ducts may be increased relative to fuel injectors that do not include the flange 204 and are not coupled with the cylinder head 200 at the inner side 252. For example, increasing the angle 313 between the opposing ducts may increase the length 232 between the opposing ducts (e.g., to a length greater than the diameter 228 of the passage 226). As a result, fuel injectors that include the increased angle 313 between the opposing ducts may not be able to be inserted into the passage 226 in a direction from the outer side 250 to the inner side 252 of the cylinder head 200 (e.g., from outer surface 229 to inner surface 213). However, fuel injector 202 shown by FIGS. 2-4 includes the ducts separated by angle 313 and spaced apart by length 232, and because fuel injector 202 includes flange 204 configured to mate with shoulder 224, the fuel injector 202 may be coupled with the cylinder head 200 at the inner side 252 while maintaining the relative angle 313 and length 232 between the ducts 206.

In one example, enabling the increased amount of angle between the opposing ducts may increase an amount of fuel/air mixing within the combustion chamber 400 of the engine during conditions in which the cylinder head 200 is coupled with the engine block 408, as shown by FIG. 4. The angle 313 may result in a greater amount of fuel spraying from nozzle 208 and through the ducts 206 in directions away from piston 406. Spraying the fuel away from the piston 406 may increase an amount of time in which the fuel mixes with air within the combustion chamber and may result in increased engine performance (e.g., increased combustion stability and/or reduced diesel engine soot emissions). As one example, the angle 313 between the ducts may be within a range of 0° to 180°. In another example, the angle 313 between the ducts may be within a range of 80° to 180°.

FIG. 4 shows the cylinder head 200 coupled with engine block 408 to form combustion chamber 400. Piston 406 is disposed within the combustion chamber 400. Piston 406 may be similar to piston 138 shown by FIG. 1 and described above, and combustion chamber 400 may be similar to combustion chamber 14 shown by FIG. 1 and described above. Assembly of the engine may proceed sequentially from FIG. 3 to FIG. 4, such that the fuel injector 202 is coupled to the cylinder head 200 at the inner side 252 prior to coupling the cylinder head 200 with the engine block 408.

Due to the coupling of the fuel injector 202 with the cylinder head 200 at the inner side 252 of the cylinder head 200 via engagement of the flange 204 with the shoulder 224, sealing between the cylinder head 200 and the fuel injector 202 may be increased. For example, coupling the fuel injector 202 with the cylinder head 200 at the inner side 252 may decrease a likelihood of fuel, air, and/or combustion gases from flowing between the flange 204 and the shoulder 224. In some examples, the sealing between the cylinder head 200 and the fuel injector 202 may further increase as combustion chamber pressures increase. Further, the position of the fuel injector 202 relative to the cylinder head 200 may be more easily maintained. Specifically, during conditions in which the engine is running and fuel/air is combusted within the combustion chamber 400, forces resulting from the combustion may press the flange 204 against the surfaces of the shoulder 224 and may increase engagement of the flange 204 with the shoulder 224. As a result, a likelihood of the position of the fuel injector 202 shifting relative to the cylinder head 200 may be reduced, and a maintenance frequency of the fuel injector may be decreased.

Turning now to FIGS. 5-7, another example of coupling a fuel injector 501 (shown fully assembled by FIG. 7) to the cylinder head 200 at the inner side 252 of the cylinder head 200 is shown. As shown by FIG. 7, fuel injector 501 includes a duct section 502 and a nozzle section 600 (which may be referred to as a duct assembly and nozzle assembly, respectively), with the nozzle section 600 shaped to fit within (e.g., seat within) the duct section 502. The duct section 502 and nozzle section 600 are removably coupleable with each other, with the duct section 502 adapted to couple with the cylinder head 200 at the inner side 252 of the cylinder head 200, and with the nozzle section 600 adapted to couple with the duct section 502 at the outer side 250 of the cylinder head 200. FIGS. 5-7 show various stages of coupling of the fuel injector 501 with the cylinder head 200. Specifically, FIG. 5 shows the duct section 502 in a decoupled position relative to the cylinder head 200 with the nozzle section 600 separated from the duct section 502, FIG. 6 shows the duct section 502 coupled to the cylinder head 200 at the inner side 252 of the cylinder head 200 with the nozzle section 600 separated from the duct section 502, and FIG. 7 shows nozzle section 600 disposed within the duct section 502 and the cylinder head 200 coupled to engine block 408. The stages of coupling of the fuel injector 501 with the cylinder head 200 may occur sequentially from FIG. 5 to FIG. 7. Components shown by FIGS. 2-4 may be similarly labeled in FIGS. 5-7 and may not be re-introduced here.

Starting with FIG. 5, duct section 502 is shown decoupled from the cylinder head 200 and positioned at the inner side 252 of the cylinder head 200, and nozzle section 600 is shown decoupled from the duct section 502 and cylinder head 200 and positioned at the outer side 250. Duct section 502 includes ducts 206 and flange 204, similar to the fuel injector 202 described above with reference to FIGS. 2-4. Ducts 206 are integrally formed with flange 204 (which may be referred to herein as an end flange). For example, ducts 206 and flange 204 may be formed together as a single, integrated unit (e.g., molded together). In some examples, ducts 206, flange 204, and nozzle 208 may be formed together as a single, integrated unit. As described above, flange 204 is shaped to seat within shoulder 224 of the cylinder head 200. For example, duct section 502 may be coupled with the cylinder head 200 by inserting the duct section 502 into passage 226 in insertion direction 210. As the duct section 502 is inserted into the passage 226, flange 204 may mate with the surfaces of the shoulder 224 in order to maintain the duct section 502 in engagement with the cylinder head 200.

Duct section 502 further includes first opening 512 and second opening 514, with the first opening 512 positioned opposite to the second opening 514 (e.g., positioned at an opposite end of the duct section 502 relative to the second opening 514). First opening 512 and second opening 514 each open to interior 508 of the duct section 502, with the interior 508 formed by body 505 of the duct section 502 (which may be referred to herein as a duct body). During conditions in which the nozzle section 600 is coupled with the duct section 502 (e.g., seated within the interior 508 of the duct section 502, as shown by FIG. 7), the nozzle 208 of the nozzle section 600 protrudes (e.g., extends outward) through the first opening 512. Nozzle 208 may be formed together with nozzle section 600 (e.g., formed as a single, integrated unit with a body of nozzle section 600), and ducts 206 may be formed together with duct section 502 (e.g., formed together as a single, integrated unit with body 505 of duct section 502).

FIG. 6 shows the duct section 502 coupled with the cylinder head 200, and the cylinder head 200 coupled with engine block 408. In some examples, duct section 502 may be press-fit coupled to cylinder head 200 and/or fastened to cylinder head 200 (e.g., via a clamp). In the configuration shown by FIG. 6, the flange 204 is seated within the shoulder 224, and the position of the duct section 502 relative to the cylinder head 200 is maintained via engagement of the surfaces of the flange 204 with the surfaces of the shoulder 224. In this configuration, outer surfaces 598 of the duct section 502 (e.g., outer surfaces of body 505 of duct section 502) engage with the inner surfaces 299 of the passage 226 (e.g., the outer surfaces 598 are positioned in face-sharing contact with the inner surfaces 299, with no other components positioned there-between). However, in the configuration shown by FIG. 6, nozzle section 600 is not coupled with the duct section 502 or cylinder head 200. Instead, nozzle section 600 is shown decoupled from the duct section 502 and cylinder head 200 and is positioned at the outer side 250 of the cylinder head 200.

In order to couple the nozzle section 600 with the duct section 502, the nozzle section 600 may be inserted from the outer side 250 through second opening 514 of the duct section 502 into the interior 508 of the duct section 502 in insertion direction 604, with the insertion direction 604 being opposite to the insertion direction 210, and with second opening 514 being positioned at the outer side 250. Specifically, in the configuration shown by FIG. 6, duct section 502 has been coupled with the cylinder head 200 from the inner side 252, and nozzle section 600 may be coupled with the duct section 502 from the outer side 250 while the flange 204 is seated within the shoulder 224. In some examples, nozzle section 600 may be coupled to duct section 502 via a fastener (e.g., a clamping mechanism). The fastener may compress the nozzle section 600 and duct section 502 together in order to maintain the position of the nozzle section 600 and duct section 502 relative to the cylinder head 200 (e.g., secure the nozzle section 600 and duct section 502 to the cylinder head 200 together). Coupling the nozzle section 600 with the duct section 502 via the fastener may increase an amount of sealing between the nozzle section 600 and the duct section 502 (e.g., reduce a likelihood of fuel, air, and/or combustion gases from flowing between an interface between the nozzle section 600 and the duct section 502).

The nozzle section 600 may include locking elements (e.g., teeth, tabs, etc.) shaped to mate with counterpart locking elements of the body 505 of the duct section 502 (e.g., grooves, slots, etc.) in order to lock the nozzle section 600 (e.g., the body of the nozzle section 600) to the duct section 502 (e.g., the body 505 of the duct section 502). The nozzle section 600 is shaped to seat within interior 508 of the duct section 502. The ducts 206 are coupled to bottom 265 of the flange 204, with the bottom 265 being positioned at the inner side 252 while the flange 204 is seated within the shoulder 224. The ducts 206 extend outward from the bottom 265, and the nozzle 208 extends outward from the bottom 265 between the ducts 206 (e.g., the ducts 206 are positioned around the nozzle 208 and encircle the nozzle 208 at the bottom 265) when the nozzle section 600 is coupled with the duct section 502 (e.g., the nozzle is coupled within the interior 508 of the body 505 of the duct section 502).

Although the cylinder head 200 is shown coupled to the engine block 408 in the configuration shown by FIG. 6, in other examples duct section 502 may be coupled with the cylinder head 200 without coupling the cylinder head 200 with the engine block 408. For example, as described above, the stages (e.g., stages of assembly or coupling of the cylinder head 200 and fuel injector 501) shown by FIGS. 5-7 may occur sequentially (e.g., with the stage or configuration shown by FIG. 5 occurring before the stage or configuration shown by FIG. 6, and with the stage or configuration shown by FIG. 6 occurring before the stage or configuration shown by FIG. 7). Coupling of the cylinder head 200 with the engine block 408 may occur after coupling the duct section 502 with the cylinder head 200 and either before coupling the nozzle section 600 with the duct section 502 (as shown by FIG. 6) or after coupling the nozzle section 600 with the duct section 502. Seating the flange 204 within the shoulder 224 may first include inserting duct section 502 of the fuel injector 501 into the passage 226 from inner side 252 of the cylinder head 200, and then inserting nozzle section 600 of the fuel injector 501 into the passage 226 from outer side 250 of the cylinder head 200. Inserting the nozzle section 600 of the fuel injector 501 into the passage 226 from the outer side 252 includes mating the nozzle section 600 with the duct section 502.

FIG. 7 shows the nozzle section 600 coupled with the duct section 502, with the duct section 502 coupled to the cylinder head 200 via the flange 204 seated within the shoulder 224. As described above, in order to couple the nozzle section 600 with the duct section 502, the nozzle section 600 may be inserted into the interior 508 of the duct section 502 from the outer side 250 while the duct section 502 is coupled to the cylinder head 200 via the flange 204 seated within the shoulder 224. In this configuration, the nozzle 208 of the nozzle section 600 protrudes outward from the first opening 512 of the duct section 502 (shown by FIGS. 5-6).

Holes of the nozzle 208 adapted to deliver fuel to the combustion chamber 400 are positioned to align with the ducts 206 during conditions in which the nozzle section 600 is coupled to the duct section 502 (e.g., locked to the body 505 of the duct section 502 via the locking elements). Specifically, each hole of the nozzle 208 is positioned to align with a corresponding duct 206 of the duct section 502, such that fuel flowing from the holes of the nozzle 208 is directed through the ducts 206 and is delivered to the combustion chamber 400 as fuel sprays 207. In some examples, the ducts 206 of the duct section 502 and the holes of the nozzle 208 may be co-manufactured. For example, during manufacturing of the fuel injector 501, the nozzle section 600 and duct section 502 may be temporarily coupled together in order to position the ducts 206 proximate to the nozzle 208. The holes of the nozzle 208 may then be formed (e.g., machined) while the nozzle section 600 and duct section 502 are in the coupled configuration in order to ensure that each hole of the nozzle 208 is aligned with a corresponding duct of the duct section 502 when the duct section 502 is coupled to the cylinder head 200 and the nozzle section 600 is seated within the duct section 502. By aligning the holes of the nozzle 208 with the ducts 206 of the duct section 502 during manufacturing of the fuel injector 501, the duct section 502 and nozzle section 600 may be separated from each other prior to coupling of the fuel injector 501 with the cylinder head 200. In this way, the alignment of the holes of the nozzle 208 with the ducts 206 may be maintained when the duct section 502 is coupled with the cylinder head 200 at the inner side 252 of the cylinder head 200 and the nozzle section 600 is coupled with the duct section 502 at the outer side 250 of the cylinder head 200 (as shown by FIG. 7).

By coupling the fuel injector 501 to the cylinder head 200 via engagement of the flange 204 of the duct section 502 with the shoulder 224 and coupling the nozzle section 600 to the duct section 502 as described above, the length of the ducts 206 may be increased (e.g., as described above with reference to FIGS. 2-4). In one example, a width between the ducts in a radial direction of central axis 700 of the fuel injector 501 (e.g., similar to length 232 shown by inset 311 of FIG. 3) is greater than a width 702 (shown by FIG. 7) of the remainder of the body of the duct section 502 (e.g., similar to diameter 205 shown by FIG. 2).

FIGS. 8-10 show another example of coupling a fuel injector 801 (shown fully assembled by FIG. 10) to cylinder head 200 at the inner side 252 of the cylinder head 200. In the example shown by FIGS. 8-10, the fuel injector 801 includes duct section 800 (which may be referred to herein as a duct body) and nozzle section 805, with the nozzle section 805 shaped to seat within an interior of the duct section 800. Duct section 800 includes body 803, with body 803 being shaped to fit within the passage 226 (e.g., having approximately the same diameter as the passage 226) during conditions in which the fuel injector 801 is coupled to the cylinder head 200. During conditions in which body 803 is positioned within the passage 226, outer surfaces 898 engage with (e.g., are positioned in face-sharing contact with) the inner surfaces 299 of the passage 226. Nozzle section 805 includes nozzle 208, with the nozzle 208 positioned to extend in an outward direction from flange 204 of the duct section 800. FIGS. 8-10 shown different stages of coupling of the fuel injector 801 with the cylinder head 200. In one example, the stages may occur sequentially from FIG. 8 to FIG. 10. For example, FIG. 8 shows the duct section 800 and nozzle section 805 (which may be referred to herein collectively as nozzle/duct section 807) decoupled from the cylinder head 200, FIG. 9 shows the nozzle/duct section 807 coupled to the cylinder head 200 at the inner side 252, and FIG. 10 shows outer section 900 of the fuel injector 801 coupled to the nozzle/duct section 807 at the outer side 250. Coupling of the nozzle/duct section 807 with the cylinder head 200 at the inner side 252 (as shown by FIG. 9) occurs prior to coupling the outer section 900 to the nozzle/duct section 807 at the outer side 250 (as shown by FIG. 10). Components shown by FIGS. 8-10 that are similar to those shown by FIGS. 2-7 and described above may be labeled similarly and may not be re-introduced here.

As described above, FIG. 8 shows the nozzle/duct section 807 decoupled from the cylinder head 200. Nozzle/duct section 807 may be coupled to the cylinder head 200 by seating the flange 204 within the shoulder 224, similar to the examples described above with reference to FIGS. 2-7. For example, nozzle/duct section 807 may be inserted into the passage 226 from the inner side 252 of the cylinder head 200 in insertion direction 210, with the flange 204 engaging with surfaces of the shoulder 224 to maintain the position of the nozzle/duct section 807 relative to the cylinder head 200. Seating the flange 204 within the shoulder 224 includes first inserting the nozzle/duct section 807 of fuel injector 801 into the passage 226 from inner side 252 of the cylinder head 200, and then coupling outer section 900 of the fuel injector 801 to the nozzle/duct section 807 at the outer side 250 of the cylinder head 200.

FIG. 9 shows the nozzle/duct section 807 coupled with the cylinder head 200. Outer section 900 of the fuel injector 801 may be coupled with the nozzle/duct section 807 at the outer side 250. For example, outer section 900 may include an opening 904 adapted to engage with an end of the nozzle/duct section 807 positioned at the outer side 250. Outer section 900 may be coupled to the nozzle/duct section 807 by engaging the opening 904 with the nozzle/duct section 807 in direction 902. In some examples, the outer section 900 may include an electrical connector, fuel supply fitting, and/or passages configured to deliver fuel through the fuel injector 801 to the nozzle/duct section 807. The outer section 900 may further include a fuel return fitting and passages configured to flow fuel from the nozzle/duct section 807 to the fuel return fitting. Each of the components of the outer section 900 may be positioned at a top of the fuel injector 801 (e.g., at the portion of the fuel injector 801 protruding from cylinder head 200 at the outer side 250), and the outer section 900 may have a diameter larger than diameter 228. In other examples, the diameter of the outer section 900 may be smaller than the diameter 228 and/or outer section 900 may be partially seated within passage 226. In some examples, the outer section 900 may further include an actuator (e.g., piezo stack or solenoid valve) or a control valve to control movement of a needle of the fuel injector 801.

FIG. 10 shows the fuel injector 801 in the fully assembled configuration coupled to the cylinder head 200. Specifically, FIG. 10 shows the nozzle/duct section 807 coupled to the cylinder head 200 at the inner side 252 of the cylinder head 200. Further, outer section 900 is coupled to the nozzle/duct section 807 at the outer side 250 of the cylinder head 200.

In some examples, the nozzle section 805 and duct section 800 may be co-manufactured, as described above with reference to the example shown by FIGS. 5-7. Specifically, the nozzle section 805 and duct section 800 may be removably coupled with each other (e.g., separable from each other), and holes of the nozzle 208 may be formed while the nozzle section 805 and duct section 800 are coupled together during manufacturing in order to ensure alignment of the holes with ducts 206 when the nozzle/duct section 807 is coupled to cylinder head 200.

FIG. 11 shows a flowchart illustrating a method 1100 for coupling a fuel injector to a cylinder head. In some examples, the fuel injector may be similar to fuel injector 202 described above with reference to FIGS. 2-4, fuel injector 501 described above with reference to FIGS. 5-7, and/or fuel injector 801 described above with reference to FIGS. 8-10. The cylinder head described herein with reference to the method 1100 may be similar to the cylinder head 200 described above with reference to FIGS. 2-10, and/or the cylinder head 167 described above with reference to FIG. 1.

The method 1100 at 1102 includes providing the cylinder head including a passage extending from an outer surface to an inner surface of the cylinder head, with a shoulder formed within the passage proximate to the inner surface, the shoulder forming a larger passage opening at the inner surface than the outer surface. In one example, the outer surface, inner surface, shoulder, and passage may be similar to the outer surface 229, inner surface 213, shoulder 224, and passage 226, respectively, described above with reference to FIGS. 1-10.

The method continues from 1102 to 1106 where the method includes seating a flange positioned at a distal end of the fuel injector within the shoulder, the flange being wider than a body of the fuel injector extending toward a proximal end of the fuel injector, the fuel injector including a nozzle and a plurality of ducts arranged at the distal end. In one example, the flange, body of the fuel injector, nozzle, and ducts may be similar to the flange 204, body 203, nozzle 208, and ducts 206, respectively, described above (and shown by FIG. 2, for example). Specifically, the body of the fuel injector refers to the portion of the fuel injector that fits within the passage of the cylinder head (e.g., the portion that has approximately the same diameter as the passage). For example, the body may be body 203 described above with reference to FIGS. 2-4, body 505 described above with reference to FIGS. 5-7, or body 803 described above with reference to FIGS. 8-10. At 1106, the method may include inserting the body of the fuel injector into the passage, as indicated by insertion direction 210 described above (and shown by FIG. 2, for example). Seating the flange within the shoulder may include engaging (e.g., mating) the flange with surfaces of the shoulder, as described above.

Further, at 1106, the method 1100 may include positioning the plurality of ducts at an inner side of the cylinder head, the inner side including the inner surface, as indicated at step 1108. For example, seating the flange within the shoulder may position the plurality of ducts proximate to the inner surface, with the inner surface being similar to inner surface 213 described above (and shown by FIG. 2, for example) in at least one example. The plurality of ducts may extend in an outward direction relative to the inner surface at the inner side. The inner side may be similar to inner side 252 described above (and shown by FIG. 2, for example).

The method at 1106 may additionally include inserting the flange through the larger passage opening at the inner surface and not inserting the flange through the passage opening at the outer surface, as indicated at step 1110. The outer surface may be similar to outer surface 229 described above (and shown by FIG. 2, for example). Specifically, the flange is coupled to the cylinder head at the inner side and not the outer side (e.g., the flange is seated within the shoulder at the inner side and does not pass through the opening at the outer side during coupling of the fuel injector with the cylinder head).

In some examples, the method may continue from 1106 to optional step 1112 where the method includes engaging a protrusion of the cylinder head at the inner surface with a counterpart slot of an engine block of an engine. For example, the protrusion, counterpart slot, and engine block may be similar to the protrusion 212, slot 402, and engine block 408 described above (and shown by FIG. 4, for example). The engine may be similar to engine 10 shown by FIG. 1 and described above. At 1112, the method includes positioning the protrusion in face-sharing contact with the slot of the engine block (e.g., mating the protrusion with the slot of the engine block). In examples in which the cylinder head does not include the protrusion and/or the engine block does not include the counterpart slot, optional step 1112 may not be performed.

FIGS. 2-10 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In this way, by coupling the fuel injector with the cylinder head by seating the flange within the shoulder, the ducts of the fuel injector are positioned at the inner side of the cylinder head without inserting the ducts through the passage of the cylinder head. As a result, the length of the ducts may be increased, and mixing of fuel/air within the combustion chamber via the ducts may be increased. Further, the nozzle of the fuel injector and the ducts may be co-manufactured in order to increase the alignment of the holes of the nozzle with the ducts. The fuel injector may be maintained in engagement with the cylinder head via the flange seated within the shoulder, and the combustion of fuel/air within the combustion chamber may apply force to the flange seated within the shoulder to press the flange into the shoulder and reinforce the coupling of the fuel injector with the cylinder head.

In one embodiment, a system comprises: a cylinder head including a passage extending from an outer surface to an inner surface of the cylinder head, a shoulder formed within the passage proximate to the inner surface, the shoulder forming a larger passage opening at the inner surface than the outer surface, the inner surface forming a top of a combustion chamber; and a fuel injector including a nozzle and a plurality of ducts arranged at a distal end of the fuel injector, where the distal end includes a flange that is wider than a body of the fuel injector extending toward a proximal end of the fuel injector, the flange adapted to seat within the shoulder. In a first example of the system, each duct of the plurality of ducts includes a first end and a second end, the first end positioned closer to the flange than the second end, and wherein a length between each second end of opposing ducts of the plurality of ducts is greater than a diameter of the passage. A second example of the system optionally includes the first example, and further includes wherein a length of each duct of the plurality of ducts is greater than half a diameter of the passage. A third example of the system optionally includes one or both of the first and second examples, and further includes a plurality of protrusions extending from the inner surface of the cylinder head, the plurality of protrusions shaped to engage with a plurality of counterpart grooves of an engine block. A fourth example of the system optionally includes one or more or each of the first through third examples, and further includes wherein each protrusion of the plurality of protrusions includes a terminal end offset from the inner surface, with a clearance formed between the inner surface and each terminal end, and wherein the plurality of ducts does not extend beyond the clearance while the flange is seated within the shoulder. A fifth example of the system optionally includes one or more or each of the first through fourth examples, and further includes wherein the nozzle, flange, and plurality of ducts are formed together as a single, integrated unit. A sixth example of the system optionally includes one or more or each of the first through fifth examples, and further includes wherein the nozzle is formed together with a body of a nozzle section of the fuel injector, the plurality of ducts is formed together with a body of a duct section of the fuel injector, and the nozzle section is removably coupleable with the duct section. A seventh example of the system optionally includes one or more or each of the first through sixth examples, and further includes wherein the body of the nozzle section includes locking elements shaped to mate with counterpart locking elements of the body of the duct section to lock the body of the nozzle section to the body of the duct section, and where the nozzle includes a plurality of holes, with each hole of the plurality of holes positioned to align with a corresponding duct of the plurality of ducts when the body of the duct section is locked to the body of the nozzle section. An eighth example of the system optionally includes one or more or each of the first through seventh examples, and further includes wherein the nozzle section is shaped to seat within an interior of the duct section through an opening of the duct section positioned at an end opposite to the plurality of ducts. A ninth example of the system optionally includes one or more or each of the first through eighth examples, and further includes wherein, with the flange seated within the shoulder, the opening of the duct section is disposed at an outer side of the cylinder head and the plurality of ducts is positioned at an inner side of the cylinder head, the outer side including the outer surface and the inner side including the inner surface.

In one embodiment, a method comprises: providing a cylinder head including a passage extending from an outer surface to an inner surface of the cylinder head, with a shoulder formed within the passage proximate to the inner surface, the shoulder forming a larger passage opening at the inner surface than the outer surface; and coupling a fuel injector to the cylinder head by seating a flange positioned at a distal end of the fuel injector within the shoulder, the flange being wider than a body of the fuel injector extending toward a proximal end of the fuel injector, the fuel injector including a nozzle and a plurality of ducts arranged at the distal end. In a first example of the method, the method further comprises engaging a protrusion of the cylinder head at the inner surface with a counterpart slot of an engine block of an engine. A second example of the method optionally includes the first example, and further includes wherein seating the flange within the shoulder positions the plurality of ducts at an inner side of the cylinder head, the inner side including the inner surface. A third example of the method optionally includes one or both of the first and second examples, and further includes wherein seating the flange within the shoulder includes inserting the flange through the larger passage opening at the inner surface and not inserting the flange through a smaller passage opening at the outer surface. A fourth example of the method optionally includes one or more or each of the first through third examples, and further includes wherein seating the flange within the shoulder includes first inserting a duct section of the fuel injector into the passage from an inner side of the cylinder head, the duct section including the plurality of ducts and the flange and the inner side including the inner surface, and then inserting a nozzle section of the fuel injector into the passage from an outer side of the cylinder head, the nozzle section including the nozzle and the outer side including the outer surface. A fifth example of the method optionally includes one or more or each of the first through fourth examples, and further includes wherein inserting the nozzle section of the fuel injector into the passage from the outer side includes seating the nozzle section with an interior of the duct section. A sixth example of the method optionally includes one or more or each of the first through fifth examples, and further includes wherein seating the flange within the shoulder includes first inserting a nozzle/duct section of the fuel injector into the passage from an inner side of the cylinder head, the nozzle/duct section including both of the plurality of ducts and the nozzle and the inner side including the inner surface, and then coupling an outer section of the fuel injector to the nozzle/duct section at an outer side of the cylinder head, the outer side including the outer surface.

In one embodiment, a fuel injector comprises: a duct assembly including a duct body having an end flange that is wider than a remainder thereof, and ducts integrally formed with the end flange; a fuel injector nozzle including holes and adapted to be coupled within the duct body to align the holes with the ducts. In a first example of the fuel injector, the ducts are coupled to a bottom of the end flange and extend outward from bottom of the end flange, the fuel injector nozzle extending outward from the bottom of the end flange between the ducts when the fuel injector nozzle is coupled within the duct body. A second example of the fuel injector optionally includes the first example, and further includes wherein a width between the ducts in a radial direction of a central axis of the fuel injector is greater than a width of the remainder of the duct body of the duct assembly.

In another embodiment, a system comprises: a cylinder head including a passage extending from an outer surface to an inner surface of the cylinder head, the passage including a shoulder forming a wider passage opening at the inner surface than the outer surface; and a fuel injector including a plurality of ducts integrated with a nozzle of the fuel injector at a distal end of the fuel injector including a flange wider than a remaining body of the fuel injector, where the flange is adapted to mate with the shoulder. In a first example of the system, a central axis of the passage is arranged normal to mating surfaces of the flange and shoulder.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a cylinder head including a passage extending from an outer surface to an inner surface of the cylinder head, a shoulder formed within the passage proximate to the inner surface, the shoulder forming a larger passage opening at the inner surface than the outer surface, the inner surface forming a top of a combustion chamber; and a fuel injector including a nozzle, and a plurality of ducts arranged at a distal end of the fuel injector;

wherein the nozzle is formed together with a body of a nozzle section of the fuel injector and the plurality of ducts are integrally formed together with a body of a duct section of the fuel injector, wherein the body of the duct section further comprises a flange, wherein the flange is wider than a body of the duct section extending toward a proximal end of the fuel injector, the flange of the duct section adapted to seat within the shoulder and abut the top and sides of the shoulder; and wherein the body of the nozzle section includes locking elements shaped to mate with counterpart locking elements of the body of the duct section to lock the body of the nozzle section to the body of the duct section, and where the nozzle includes a plurality of holes, with each hole of the plurality of holes positioned to align with a corresponding duct of the plurality of ducts when the body of the duct section is locked to the body of the nozzle section.

2. The system of claim 1, further comprising a plurality of protrusions extending from the inner surface of the cylinder head, the plurality of protrusions shaped to engage with a plurality of counterpart grooves of an engine block.

3. The system of claim 2, wherein each protrusion of the plurality of protrusions includes a terminal end offset from the inner surface, with a clearance formed between the inner surface and each terminal end, and wherein the plurality of ducts does not extend beyond the clearance while the flange is seated within the shoulder.

4. The system of claim 1, wherein each duct of the plurality of ducts includes a first end and a second end, the first end positioned closer to the flange than the second end, and wherein a length between each second end of opposing ducts of the plurality of ducts is equal to or greater than a diameter of the passage.

5. The system of claim 1, wherein a length of each duct of the plurality of ducts is greater than half a diameter of the passage.

6. The system of claim 1, wherein, with the flange seated within the shoulder, the opening of the duct section is disposed at an outer side of the cylinder head and the plurality of ducts is positioned at an inner side of the cylinder head, the outer side including the outer surface and the inner side including the inner surface.

7. The fuel injector of claim 1, wherein the body of the duct section extends from the inner surface to the outer surface of the cylinder head.

8. A method, comprising:

providing a cylinder head including a passage extending from an outer surface to an inner surface of the cylinder head, with a shoulder formed within the passage proximate to the inner surface, the shoulder forming a larger passage opening at the inner surface than the outer surface; and coupling a fuel injector to the cylinder head by seating a flange positioned at a distal end of the fuel injector within the shoulder, the flange of the fuel injector being wider than a body of the fuel injector extending toward a proximal end of the fuel injector, the fuel injector including a nozzle section comprising a nozzle and nozzle body, and a duct section comprising a plurality of ducts arranged at the distal end, wherein the duct section is integrally formed with the flange;

wherein seating the flange within the shoulder includes first inserting a nozzle/duct section of the fuel injector into the passage from an inner side of the cylinder head, the nozzle/duct section including both of the plurality of ducts and the nozzle and the inner side including the inner surface, and then coupling an outer section of the fuel injector to the nozzle/duct section at an outer side of the cylinder head, the outer side including the outer surface.

9. The method of claim 8, further comprising engaging a protrusion of the cylinder head at the inner surface with a counterpart slot of an engine block of an engine.

10. The method of claim 8, wherein seating the flange within the shoulder positions the plurality of ducts at the inner side of the cylinder head, the inner side including the inner surface.

11. The method of claim 8, wherein seating the flange within the shoulder includes inserting the flange through the larger passage opening at the inner surface and not inserting the flange through a smaller passage opening at the outer surface.

12. A fuel injector, comprising:

a duct assembly including a duct body having an end flange that is wider than a remainder thereof, and a plurality of ducts integrally formed with the end flange;

a fuel injector nozzle including holes and adapted to be coupled within the duct body to align the holes with the ducts;

wherein the nozzle is formed together with a body of a nozzle section of the fuel injector and the plurality of ducts is formed together with the duct body of the fuel injector; and wherein the body of the nozzle section includes locking elements shaped to mate with counterpart locking elements of a section of the duct body to lock the body of the nozzle section to the duct body, and where the nozzle includes a plurality of holes, with each hole of the plurality of holes positioned to align with a corresponding duct of the plurality of ducts when the duct body is locked to the body of the nozzle section.

13. The fuel injector of claim 12, wherein the ducts extend outward from a bottom of the end flange, the fuel injector nozzle extending outward from the bottom of the end flange between the ducts when the fuel injector nozzle is coupled within the duct body.

14. The fuel injector of claim 12, wherein a width between the ducts in a radial direction of a central axis of the fuel injector is greater than a width of the remainder of the duct body of the duct assembly.

* * * * *